US008382111B2

(12) United States Patent
Siskin

(10) Patent No.: US 8,382,111 B2
(45) Date of Patent: Feb. 26, 2013

(54) RANDOM VALUE GENERATOR FOR GAME

(76) Inventor: Daniel Flaster Siskin, Long Beach, CA (US)

( * ) Notice: Subject to any disclaimer, the term of this patent is extended or adjusted under 35 U.S.C. 154(b) by 0 days.

(21) Appl. No.: 13/188,262

(22) Filed: Jul. 21, 2011

(65) Prior Publication Data

US 2012/0038103 A1 Feb. 16, 2012

Related U.S. Application Data

(60) Provisional application No. 61/373,237, filed on Aug. 12, 2010.

(51) Int. Cl.
*A63F 5/04* (2006.01)
*A63F 9/16* (2006.01)

(52) U.S. Cl. ..... 273/147; 273/255; 273/243; 273/138.1

(58) Field of Classification Search ..... 273/147, 273/108.53, 127 R, 138.1, 146, 255, 243
See application file for complete search history.

(56) References Cited

U.S. PATENT DOCUMENTS

| | | | | |
|---|---|---|---|---|
| 3,429,573 | A * | 2/1969 | Cederberg | 273/108 |
| 4,206,925 | A * | 6/1980 | Goldfarb et al. | 273/248 |
| 4,852,886 | A * | 8/1989 | Zaruba et al. | 273/249 |
| 5,129,655 | A * | 7/1992 | Gillespie et al. | 273/241 |
| 5,540,439 | A * | 7/1996 | Kamentsky | 273/241 |
| 5,971,830 | A * | 10/1999 | Tobin | 446/256 |
| 6,669,197 | B1 * | 12/2003 | Lund et al. | 273/243 |
| 7,306,227 | B2 * | 12/2007 | Kenney | 273/243 |

* cited by examiner

*Primary Examiner* — Benjamin Layno
(74) *Attorney, Agent, or Firm* — Lewis and Roca LLP

(57) ABSTRACT

Random value generation in a game is provided. A board game may include a random value generator capable of movement on a surface of a board. Such movement may be initiated at one location on the board and arrive at another location on the board before stopping. The random value generator may include a plurality of faces, each indicating a value in the game. When still or at rest, a face is exposed. The value displayed on the face is a first value in the game. In addition, the movement of the random value generator may also contact one or more game pieces standing on the board. The number of game pieces that are contacted by the moving random value generator may represent a second value in the game.

18 Claims, 10 Drawing Sheets

OPERATION: MACCABEE

MAIN OBJECTIVE: Lead a squad of commandos to liberate concentration camps and rescue the most prisoners.

SET UP: Each player gets 8 cammandos and 1 flag map marker for the corresponding country they choose. Place the flag marker on the corresponding flag on the board and line up your commandos face up ○ ⊗ in front of you. Additionally each player begins with one action card depending on which country they represent: USA starts with a "Grenade": UK starts with "Boots": France starts with a "First Aid Kit": USSR starts with a "Map to nearest Resistance Camp": Shuffle the action cards and place them next to the game board. Turn over the box top with the Target Assault Area up. Then turn over all the concentration camp tiles, number side down, mix them up and place them randomly on the Nazi base hexes: Spin dreidel & whomever it points at goes first. Then go counterclockwise.

TO BEGIN A TURN, A PLAYER:

1) Players begin their first turn of the game on their drop zone:

2) Spins the Dreidel to determine movement points:
Players use one point for each hex they move onto.
Some hexes cost extra points or require special cards. (See Map)
If your spin is a:
ג (Gimel): Player has 4 movement points to use
ה (Hei): Player has 3 movement points to use
נ (Nun): Player has 1 movement point to use and draws an action card
ש (Shin): Nazi Ambush in the area so player gets no movement points.

3) Player moves to a desired location on the map within range of their movement points taking in account map terrains as well as can play an action card during movement.

4) If a player begins the turn on a Resistance Base and chooses to heal they may not move that turn.

5) If player lands on a Concentration Camp they must attack it and attempt to liberate it.

MAP: The map is comprised of 8 types of hex spaces (also see key on board):
Drop Zone: Players begin the game at their corresponding countries space on the map. If a player loses all their cammandos they must return to their base.
Grass: Players must use 1 movement point to move onto an open space.
Forest: Players must use 2 movement points to move onto a forest space.
Mountains: Players must use 3 movement points to move onto a mountain space.
Water: Players use 1 movement point and can only cross water using a Raft Card. Players may not end their turn on water.
German Patrols: Players must use 1 movement point to move onto this space. If a player spins a SHIN when beginning turn here the Nazi Ambush attacks & wounds one commando and the player turns one commando chip over to the wounded side:
Resistance Camp: Takes one movement point to land here. Then a player may spend the next turn healing commandos. A GIMEL heals 2; a HEI heals 1; a NUN heals none but the player may draw an action card; and a SHIN heals none. When spending the turn to heal, a player may not move. Once a commando is healed turn the chip over.
Concentration Camp: Players must use 1 movement point to land here then they may attack it to liberate the camp (see Liberate)

*FIG. 2A*

ADDITIONAL RULES:

Commandeer: Two players may not occupy the same hex. A player may attempt to commandeer the hex from another if they end their movement on the same hex. The two players must spin dreidels simultaneously in the target box top. The player whose dreidel spins the longest wins. The winning player may move the other player to any adjacent hex except or a water hex or non-liberated concentration camp. In addition the winner may take one action card only if they are able to guess one that is in the loser's hand.

Reinforcement: If a player attempts to liberate a concentration camp and falls, any player that is on an adjacent hex to the camp may resume the attack from that point without resetting the guards and if successful gets full credit for the victory. If more than one player is adjacent then normal turn order applies.

Backpacks: Players can only hold 7 action cards at once.

Resupply: Reshuffle discarded action cards when draw pile is depleted.

USA PIECES

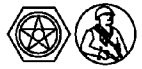

UK PIECES

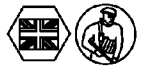

FRANCE PIECES

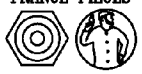

USSR PIECES

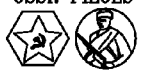

BOOT CAMP:

How to toss a grenade: From outside the target box top players must toss a grenade with no more than an underhand flick of the wrist. Starting with the fingertips touching the surface outside the box while the entire arm must stay steady as the wrist lobs the dreidel into the playing field.

How to use a sniper: From outside the target box top, players must fire as a sniper with no more than an overhand flick of a wrist. Starting with the base of the wrist touching the surface outside the box while the entire arm must stay steady as the wrist alone fires the dreidel into the playing field.

ACTION CARD

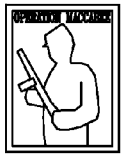

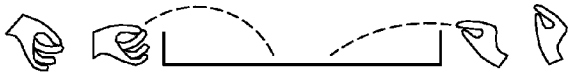

FIG. 2B

LIBERATE: Once a player lands on a concentration camp they have an opportunity to liberate the camp and save the prisoners. The player that saves the most prisoners wins the game. This part of the game takes place in the target box top.

Set up: Place nine Nazi Guards in the little circles on the outer rim of the target. Then the player:

1) Spins the dreidel in the center circle once for every healthy commando in their squad attempting to knock the Nazi Guards over killing them.

2) After each spin the result of the spin has the following effects:

GIMEL = Kill 2 more

HEI = Kill 1 more

NUN = Kill no extra but take one action card (only one free card per combat)

SHIN = Commando that took the shot is wounded. Turn over that commando token to the wounded side.

3) Players may use action cards like grenades and snipers (see boot camp)

4) If a player spin begins outside the inner circle the spin does not count and the commando is wounded. The player does not get to re-spin that one.

5) Once the player has taken all of the commandos' shots (spins) the cambat is over. If the player killed all the Nazi guards then they have succesfully liberated the camp and take the camp's hex chip which will have two numeric values: the number on top is prisoners freed and the one on bottom is the number of action cards the player is awarded. If the player did not kill all the Nazi Guards then the player places the player token on an adjacent red hex. The next time the camp is attacked it begins with all nine guards no matter how many were killed unless another player uses "Reinforcements"

Winner: Once all the concentration camps have been liberated players count how many prisoners they liberated, Player with the most wins.

RANDOM VALUE GENERATOR FOR GAME

CROSS-REFERENCE TO RELATED APPLICATIONS

The present patent application claims the priority benefit of U.S. provisional patent application No. 61/373,237 filed on Aug. 12, 2010, the disclosure of which is incorporated herein by reference.

BACKGROUND

1. Field of the Invention

The present invention generally relates to games. More specifically, the present invention relates to a random value generator for a game.

2. Description of the Related Art

Board games generally include a board that provides a playing surface. Such boards may include various illustrations of a gaming environment. A gaming environment may include various locations, each of which may have a meaning in the game or a gaming consequence. For example, a location may be a jail or prison. Another location may be a goal or winner's circle. Other locations may represent benchmarks or obstacles.

Such board games may further include game pieces associated with one or more players. A particular game piece may represent the player or certain resources available to the player. Such pieces may include various tokens, cards, or combinations of the foregoing. Each piece may further be associated with certain game status, which may be either desirable or undesirable.

Many presently available board games use dice or some other random value generator (e.g., a spinning wheel) to control the moves that a game piece can make. Such dice may be thrown onto a board or other surface. Each side of a die is marked with a value, and the value on the side that eventually faces up determines the type of move that a player can make. For example, a dice throw resulting in a value of seven allows a player to make a move associated with the value of seven (e.g., move seven spots or move to a spot designated as being associated with the value seven).

SUMMARY OF THE CLAIMED INVENTION

Embodiments of the present invention include random value generation in a game. A board game may include a random value generator capable of movement on a surface of a board. Such movement may be initiated at one location on the board and arrive at another location on the board before stopping. The random value generator may include a plurality of faces, each indicating a value in the game. When still or at rest, a face is exposed. The value displayed on the face is a first value in the game. In addition, the movement of the random value generator may also contact one or more game pieces on the board. The number of game pieces that come into contact with the random value generator may represent a second value in the game.

Various embodiments may include devices for random value generation in a game. Such a device may include a body capable of being spun, wherein following initiation of movement at a first location on a surface, the body moves for a period of time and arrives at a second location on the surface before stopping. An exemplary device may further include a plurality of faces, each indicating a value in the game. One of the faces is exposed when the body is still (e.g., when no longer moving), and a first value in the game is the value indicated by the exposed face. Further, the surface may include multiple game pieces placed on the game board. During its random movement, the moving body comes into contact with a game piece, and a second value in the game may be determined based on a number of game pieces are contacted by the moving body.

Another embodiment includes board game kits. Such board game kits may include a board having a surface, one or more game pieces configured for placement on the board, and a random value generator having a body capable of moving from a first location on the board surface and arriving at a second location on the board surface before stopping. The body may further be associated with a plurality of faces, each indicating a value in the game. One of the faces is exposed when the body is still (e.g., when no longer moving), and a first value in the game is the value indicated by the exposed face. In addition, the moving body may also come into contact with a game piece on the game board, and a second value in the game may be based on a number of game pieces that are contacted by the moving body. The board game kit may further include a guide designating a plurality of consequences in the game, wherein at least one consequence is associated with the first value, the second value, or a combination of the first value and the second value.

BRIEF DESCRIPTION OF THE DRAWINGS

FIG. 2A illustrates part of an exemplary guide to an exemplary board game kit.

FIG. 2B illustrates another part of the exemplary guide of FIG. 2A.

DETAILED DESCRIPTION

Embodiments of the present invention provide for random value generation in a game. A board game may include a random value generator capable of movement on a surface of a board. Such movement may be initiated at one location on the board and arrive at another location on the board before stopping. The random value generator may include a plurality of faces, each indicating a value in the game. When still or at rest, a face is exposed. The value displayed on the face is a first value in the game. In addition, the movement of the random value generator may also knock over one or more game pieces standing on the board. The number of game pieces that tip over may represent a second value in the game.

Figure 1A:
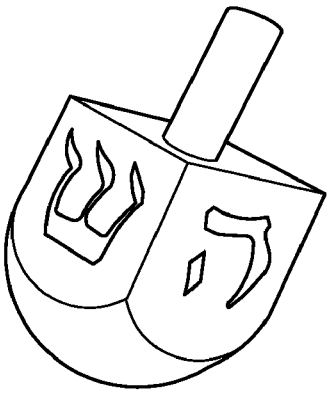
FIG. 1A illustrates an exemplary implementation of a random value generator.

FIG. 1A illustrates an exemplary implementation of a random value generator. The random value generator illustrated is in the shape of a dreidel having four faces. Two faces are illustrated in FIG. 1. As can be seen in the two faces, each face is marked with a different indicator. Each indicator may be associated with a different value according to rules provided in association with the game. As known in the art, a dreidel is capable of being spun by a player such that when the dreidel stops spinning, the dreidel falls to leave one of its faces facing upward. While a player may try to control various factors (e.g., amount of torque, energy expended, etc.) in spinning the dreidel, the chances of each face being exposed when the dreidel stops spinning may be random. In addition to random exposure of a face upon falling, movement of the dreidel around a board surface may be relatively random as well. Where a board includes a number of other game pieces, the chances that the dreidel hits another piece (or pieces) may also be random. As such, the dreidel may generate two random values per spin: the value indicated by the face lying exposed when the dreidel falls and the number of pieces (if any) that topple over upon collision with the dreidel.

Figure 1B:
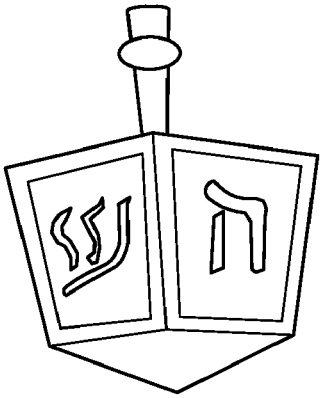
FIG. 1B illustrates an alternative implementation of a random value generator.

FIG. 1B illustrates an alternative implementation of a random value generator. Like the dreidel of FIG. 1A, the dreidel of FIG. 1B may be spun to generate two random values per spin. While the random value generators of FIGS. 1 and 2 are illustrated in the shape of a dreidel, random value generators may have any shape that includes multiple faces and that permits for random selection of one of the faces. In addition, the random value generator may further be capable of random movement around a surface of a board so as to randomly come into contact with a number of game pieces placed on the surface of the board.

Figure 1C:
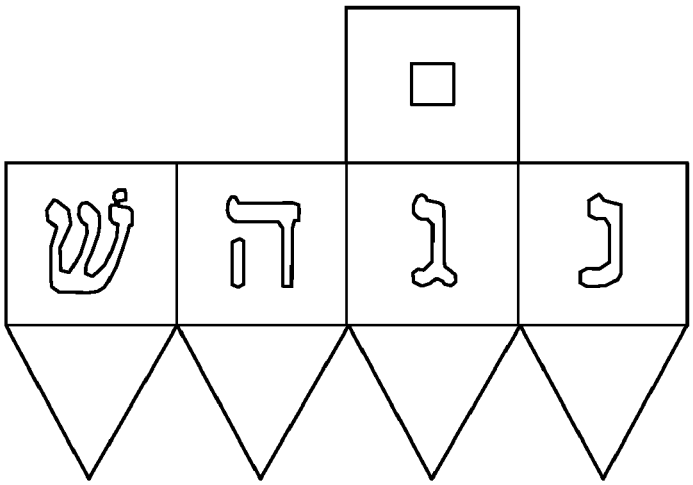
FIG. 1C illustrates a perspective view of an exemplary implementation of a random value generator.

FIG. 1C illustrates a perspective view of an exemplary implementation of a random value generator. Three-dimensional shapes may be difficult to illustrate since a realistic view may include only a few sides. The perspective view in FIG. 1C illustrates what a three-dimensional shape (e.g., the dreidel of FIG. 1B) may look like if all sides were to lay flat. As illustrated, the triangles represent the portion of the dreidel shape that permits for spinning. Each square faces marked with Hebrew letters may be randomly exposed when the dreidel stops spinning and falls. The square enclosing a smaller square represents a side with a peg that may be used by a player to initiate spinning.

Figure 3A:
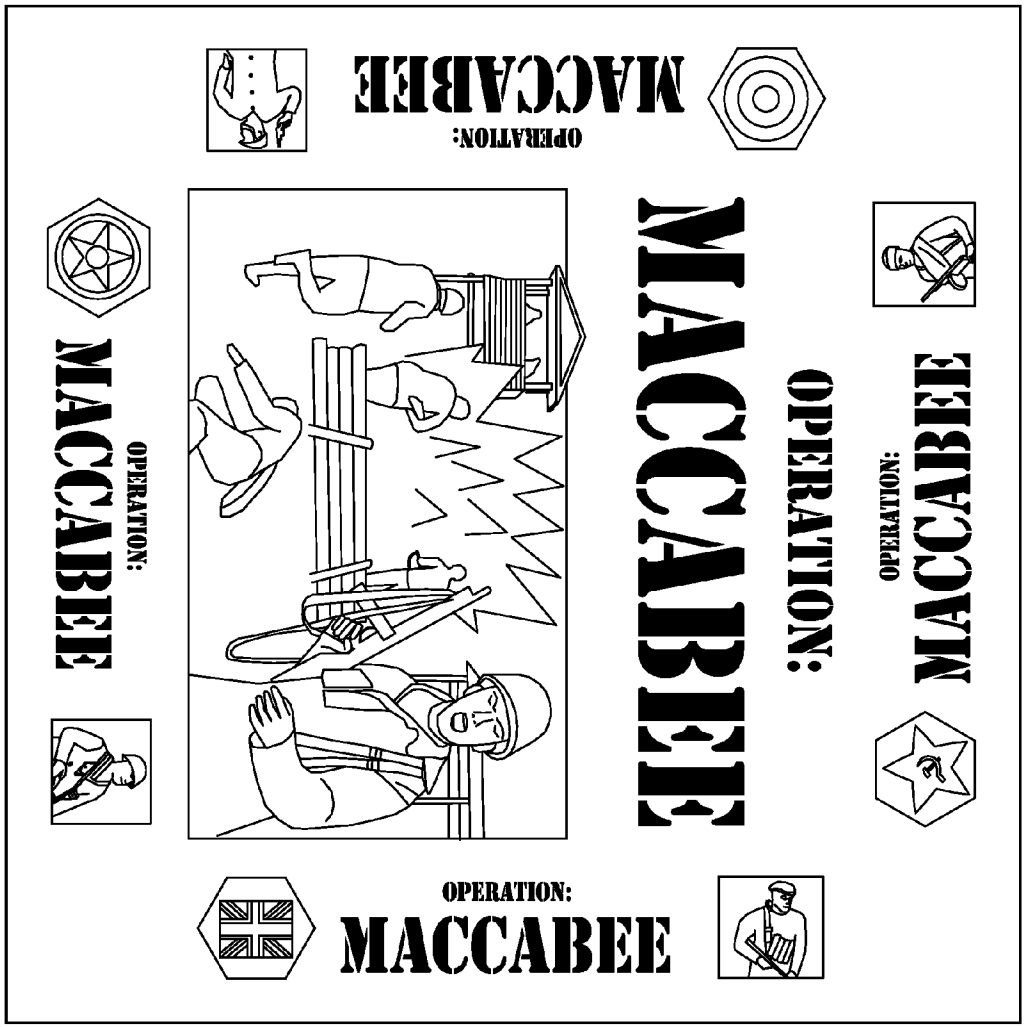
FIG. 3A illustrates front cover art for an exemplary board game kit.
Figure 3B:
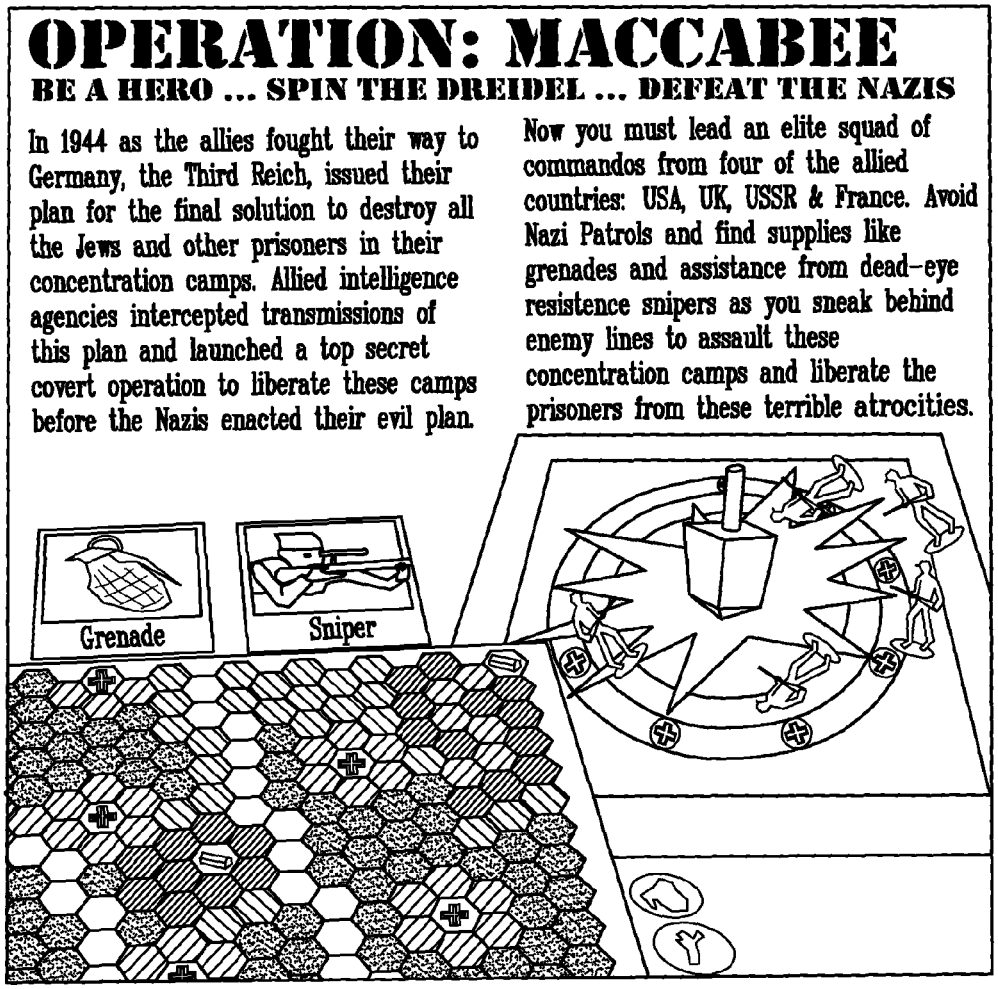
FIG. 3B illustrates back cover art for an exemplary board game kit.
Figure 4A:
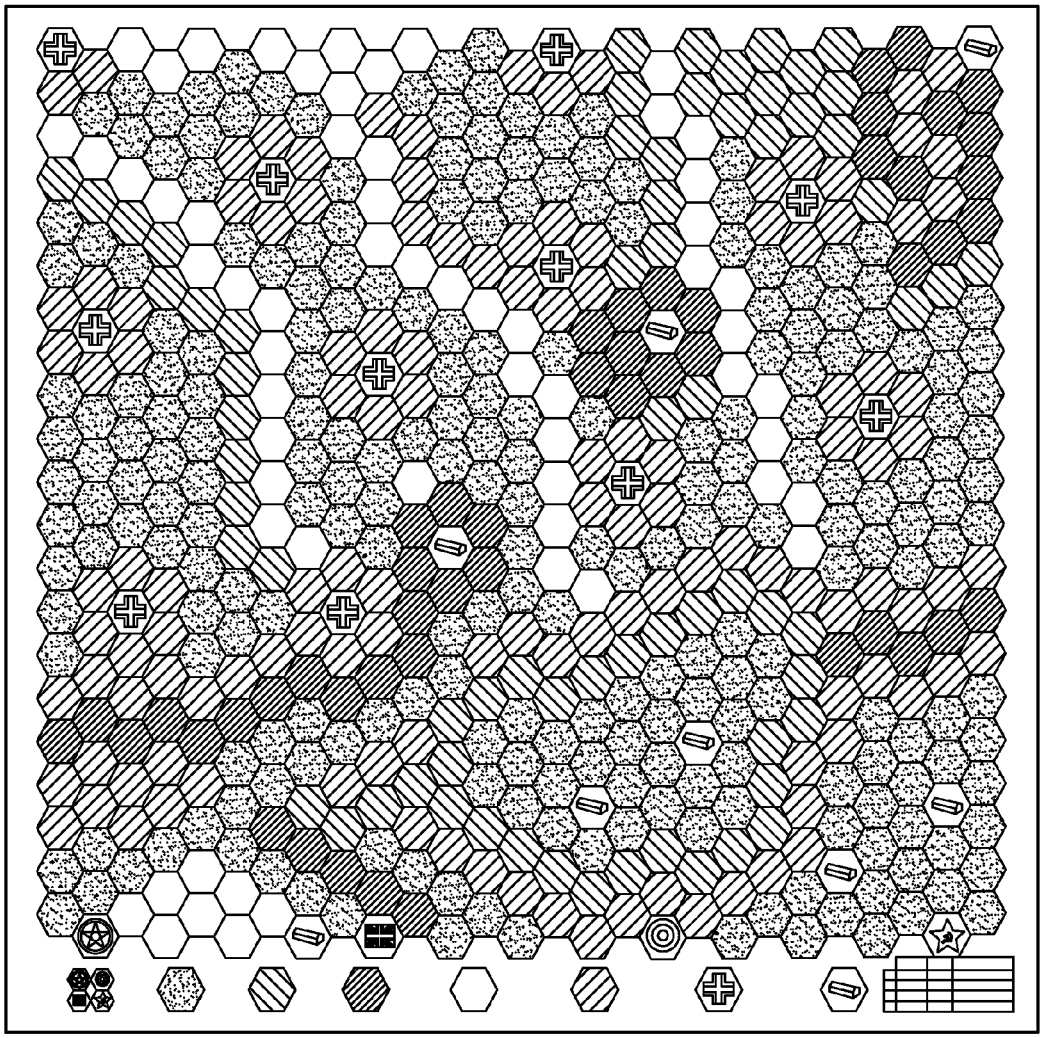
FIG. 4A illustrates a board included in an exemplary board game kit.
Figure 4B:
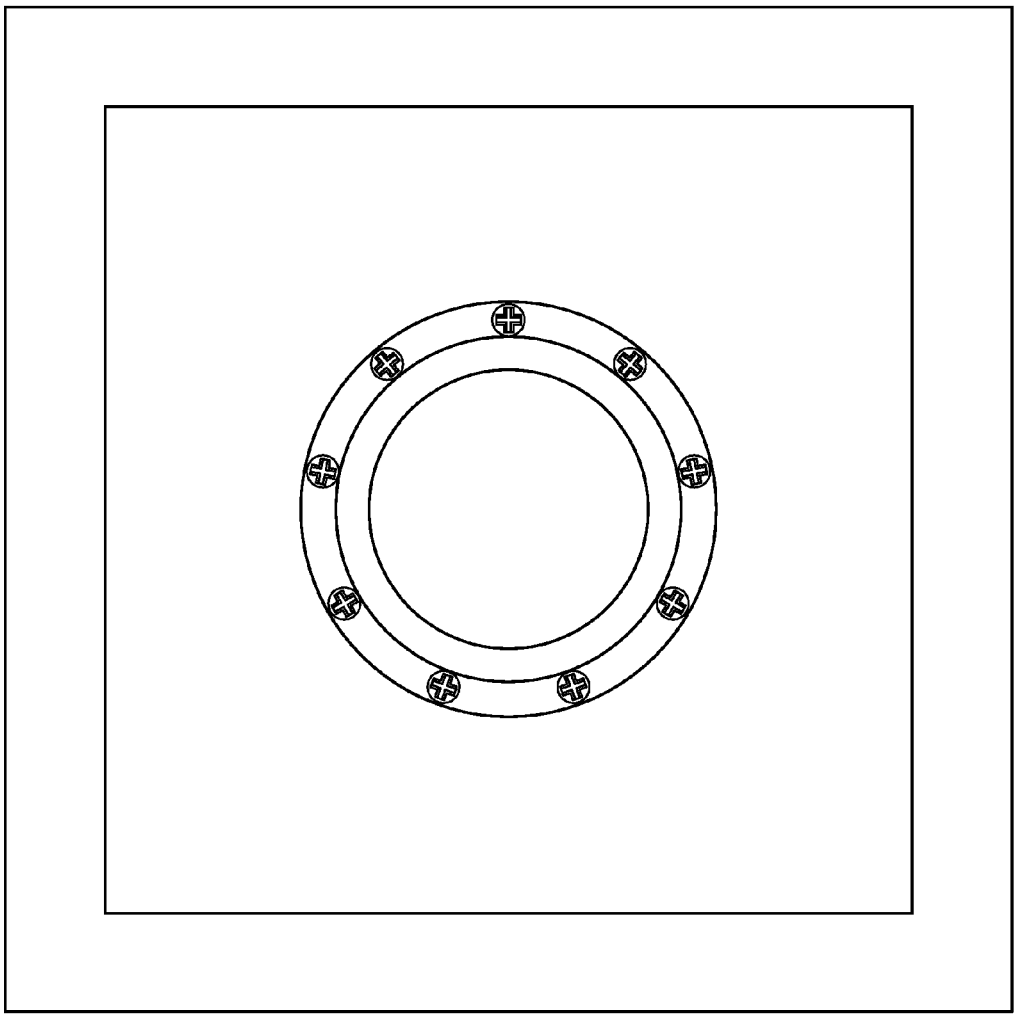
FIG. 4B illustrates an alternative board included in an exemplary board game kit
Figure 5:
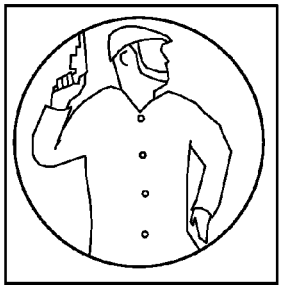
FIGS. 5-27 illustrate exemplary game cards included in an exemplary board game kit.
Figure 7:
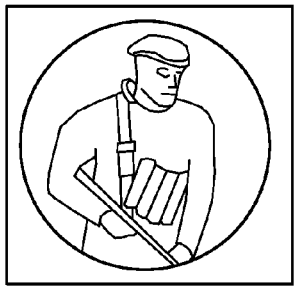
Figure 9:
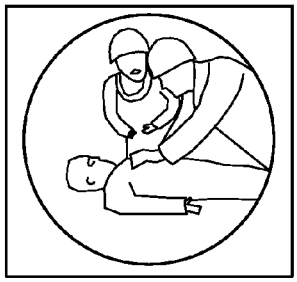
Figure 6:
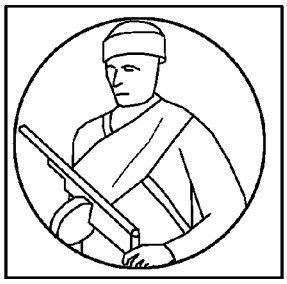
Figure 8:
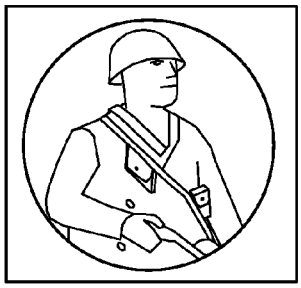
Figure 10:
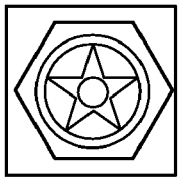
Figure 11:
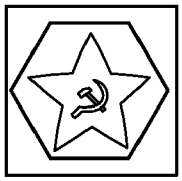
Figure 12:
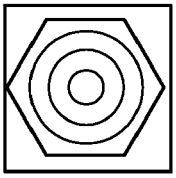
Figure 13:
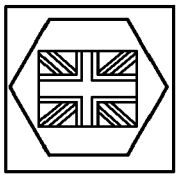
Figure 14:
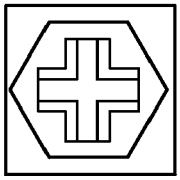
Figure 15:
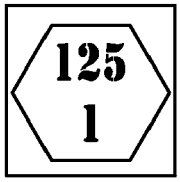
Figure 16:
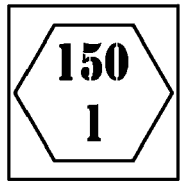
Figure 17:
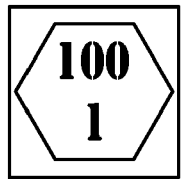
Figure 18:
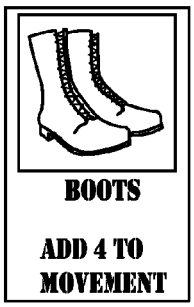
Figure 20:
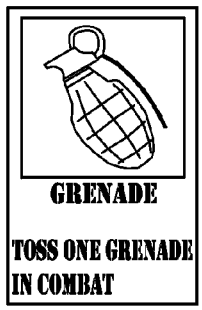
Figure 22:
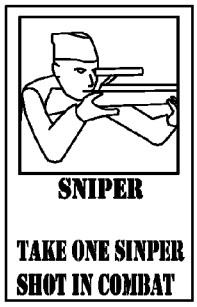
Figure 24:
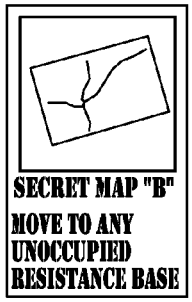
Figure 26:
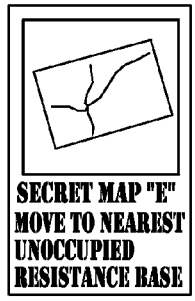
Figure 19:
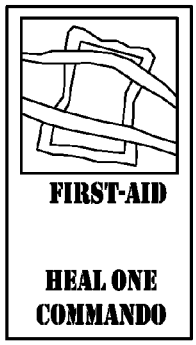
Figure 21:
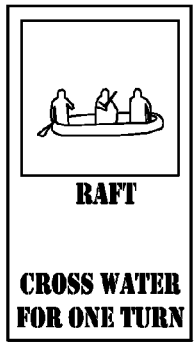
Figure 23:
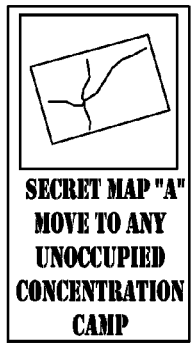
Figure 25:
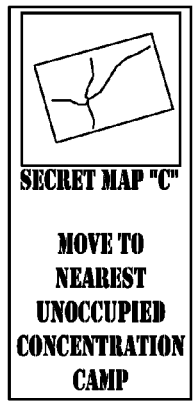
Figure 27:
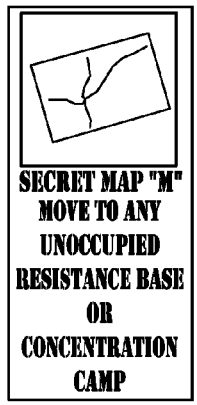

FIGS. 2A and 2B illustrate parts of an exemplary guide to an exemplary board game kit. Additional components in the exemplary board game kit may include cover art (FIGS. 3A and 3B), game board(s) (FIGS. 4A and 4B), and game cards (FIGS. 5-27). The particular board game kit illustrated in FIGS. 2-27 has a theme regarding a mission of rescuing prisoners from concentration camps. Within this theme, each player is assigned a certain country, each of which has its own resources (e.g., the player assigned to UK has a "Boots" card).

To move a game piece (such as those illustrated in FIGS. 10-13), a player accumulates movement points. Movement points may be acquired based on a random value. In one particular embodiment, such a random value may be generated by spinning a gaming top, which may be shaped as a dreidel. Each side of the dreidel may be assigned movement points. Movement points may be used to move a game piece towards various locations on the game board (e.g., drop zones, grass, forest, mountains, water, German patrol, resistance camp, concentration camp).

To win the game, a player must have liberated the largest number of prisoners from the concentration camps. As such, the player must first move his or her game pieces to the location(s) on the board designated as a concentration camp. Once at a concentration camp, the player has an opportunity to kill the Nazi guards at the camp. The Nazi guards may be represented token or figurines, which may be placed in a circle. A player may spin the dreidel in the circle and determine how many Nazi figurines tip over or topple over.

Each spin results in at least two consequences affecting game status. First, a spin may knock over a number of the Nazi figurines. Each Nazi figurine knocked over may be considered to have been killed. In addition, the gaming top indicates a value once it has stopped spinning. The value may be used to augment the kill (e.g., GIMEL of a dreidel may add two additional kills) or otherwise provide an advantage (e.g., additional action card) or disadvantage (e.g., wounded status). Once all the Nazis have been killed, the player may take a chip associated with the concentration camp. The chip may indicate a number of prisoners that have been freed by the player.

Variations on the random value generator may include any type of device that can move and generate a random value in at least two ways: based on a value on an exposed face when movement stops and based on a number of game pieces contacted by the device during movement. The type of movement may include spinning, rolling, or any type of movement known in the art to have a random result. The device may have any number of faces, each decorated with any indicator that can be associated with a value. For example, indicators may include numbers, letters, symbols, drawings, or any combinations of the foregoing. The particular value associated with the indicator may be assigned or specified by a game guide.

Further, game pieces may be any type of game piece that can be placed on a game board. Contact with a moving body may be indicated in any way known in the art. For example, an undisturbed game piece may be configured to stand upright on the game board, but upon collision, the game piece may topple. As such, determining which game pieces have been contacted by the moving body may be based simply on counting which game pieces have been toppled. Alternatively, a game piece may light up upon contact with a moving body, make a sound, or generate some other indicator discernable by the players of the game.

Moreover, while a particular embodiment described herein refers to a war or combat themed board game, embodiments of the present invention may encompass any type of theme (e.g., fantasy). For example, the game pieces being knocked down in a game may represent bottles of beer (or soda) in a "99 Bottles of Beer (or Soda)" theme. Additional war/combat themes may encompass ancient battles to modern and/or future warfare (including fantasy and science fiction scenarios).

Further, the objectives of the game may be cooperative and/or adversarial. Rather than a cooperative effort by all players (e.g., to liberate the concentration camps), the players may be pitted against each other in a territory domination theme. Such players may therefore lead opposing forces to attack each other's territories.

While various embodiments have been described above, it should be understood that they have been presented by way of example only, and not limitation. It should therefore be understood that the above description is illustrative rather than restrictive. The description is not intended to limit the scope of the invention to the particular forms set forth herein. Thus, the breadth and scope of a preferred embodiment should not be limited by any of the above-described exemplary embodiments. To the contrary, the present descriptions are intended to cover such alternatives, modifications, and equivalents as may be included within the spirit and scope of the invention as defined by the appended claims and otherwise appreciated by one of ordinary skill in the art. The scope of the invention should, therefore, be determined not with reference to the above description, but instead should be determined with reference to the appended claims along with their full scope of equivalents.

What is claimed is:

1. A device for random value generation in a game, the device comprising:

a body capable of moving on a surface of a board, wherein following initiation of movement at a first location on a surface, the body moves for a period of time and arrives at a second location on the surface before stopping;

a plurality of faces, each face indicating a value in the game, wherein a still body exposes one of the faces and wherein a first value in the game is based on the value indicated by the exposed face; and wherein the surface includes one or more game pieces, wherein the moving body comes into contact with at least one game piece, and wherein a second value in the game is based on a number of game pieces contacted by the moving body.

2. The device of claim 1, wherein the one or more game pieces are configured to indicate contact with the moving body, and wherein determining the second value includes counting the number of game pieces showing indications of contact with the moving body.

3. The device of claim 2, wherein the one or more game pieces are configured to stand upright on the surface of the board, wherein contact with the moving body causes the at least one game piece to topple, and wherein determining the second value includes counting the number of game pieces that have toppled upon contact with the moving body.

4. The device of claim 1, wherein the movement of the body includes spinning.

5. The device of claim 4, wherein the body has a shape of a dreidel and wherein the plurality of faces bears a Hebrew letter, each Hebrew letter being associated with a predefined value in the game.

6. The device of claim 5, wherein the still body points in a direction and wherein the direction has a consequence in the game.

7. The device of claim 1, wherein a combination of the first value and the second value is associated with a consequence in the game.

8. The device of claim 7, wherein the consequence is a move of a game piece and wherein the movement is based on the first value, the second value, or the combination of the first value and the second value.

9. The device of claim 7, wherein the consequence is a change in game status and wherein the change in game status is based on the first value, the second value, or the combination of the first value and the second value.

10. A board game kit, the kit comprising:

a board having a surface;

one or more game pieces configured to be placed on the surface of the board;

a random value generator comprising:

a body capable of moving on a surface of the board, wherein following initiation of movement at a first location on the surface, the body moves for a period of time and arrives at a second location on the surface before stopping, a plurality of faces, each face indicating a value in the game, wherein a still body exposes one of the faces and wherein a first value in the game is based on the value indicated by the exposed face, and wherein the moving body comes into contact with at least one game piece, and wherein a second value in the game is based on a number of game pieces contacted by the moving body; and a guide designating a plurality of consequences in the game, wherein at least one consequence is associated with the first value, the second value, or a combination of the first value and the second value.

11. The board game kit of claim 10, wherein the one or more game pieces are configured to indicate contact with the moving body, and wherein determining the second value includes counting the number of game pieces showing indications of contact with the moving body.

12. The board game kit of claim 10, wherein the one or more game pieces are configured to stand upright on the surface of the board when undisturbed, wherein contact with the moving body causes the at least one game piece to topple, and wherein determining the second value includes counting the number of game pieces that have toppled upon contact with the moving body.

13. The board game kit of claim 10, wherein the movement of the body includes spinning.

14. The board game kit of claim 13, wherein the body has a shape of a dreidel and wherein the plurality of faces bears a Hebrew letter, each Hebrew letter being associated with a predefined value in the game.

15. The board game kit of claim 14, wherein the still body points in a direction and wherein the direction has a consequence in the game.

16. The board game kit of claim 10, wherein a combination of the first value and the second value is associated with a consequence in the game.

17. The board game kit of claim 16, wherein the consequence is a move of a game piece and wherein the movement is based on the first value, the second value, or the combination of the first value and the second value.

18. The board game kit of claim 16, wherein the consequence is a change in game status and wherein the change in game status is based on the first value, the second value, or the combination of the first value and the second value.

* * * * *

UNITED STATES PATENT AND TRADEMARK OFFICE

CERTIFICATE OF CORRECTION

PATENT NO. : 8,382,111 B2
APPLICATION NO. : 13/188262
DATED : February 26, 2013
INVENTOR(S) : Daniel Flaster Siskin It is certified that error appears in the above-identified patent and that said Letters Patent is hereby corrected as shown below:

On the Title page Item (76) Inventor Daniel Flaster Siskin's mailing address should be corrected from:

5620 East 4th Street
Long Beach, CA 90814 to:

6216 E. Pacific Coast Highway #37
Long Beach, CA 90803

Signed and Sealed this
Nineteenth Day of March, 2013

Teresa Stanek Rea
*Acting Director of the United States Patent and Trademark Office*